United States Patent [19]

Sanders et al.

[11] Patent Number: 4,716,055

[45] Date of Patent: Dec. 29, 1987

[54] CONDUCTIVE FIBER AND METHOD OF MAKING SAME

[75] Inventors: John H. Sanders, Newport News, Va.; Louis D. Hoblit, Lake Jackson, Tex.; Joe A. Mann, Greensboro, N.C.

[73] Assignee: BASF Corporation, Williamsburg, Va.

[21] Appl. No.: 762,360

[22] Filed: Aug. 5, 1985

[51] Int. Cl.[4] ..... C23C 18/30

[52] U.S. Cl. ..... 427/304; 264/176.1; 264/177.18; 264/177.2; 264/182; 264/205; 264/206; 427/305; 427/306

[58] Field of Search ..... 427/306, 304, 305; 264/176.1, 177.18, 177.2, 182, 205, 206

[56] References Cited

U.S. PATENT DOCUMENTS

| | | | |
|---|---|---|---|
| 3,686,019 | 8/1972 | Ohfuka . | |
| 3,967,010 | 6/1976 | Maekawa | 427/306 |
| 4,085,066 | 4/1978 | Gulla | 427/306 |
| 4,201,825 | 5/1980 | Ebneth | 427/306 |
| 4,238,440 | 12/1980 | Logullo | 264/176.1 |

FOREIGN PATENT DOCUMENTS

| | | | |
|---|---|---|---|
| 52-35800 | 9/1977 | Japan | 427/306 |

*Primary Examiner*—John D. Smith

*Attorney, Agent, or Firm*—Rupert B. Hurley, Jr.; Edward F. Sherer; Tom R. Vestal

[57] ABSTRACT

A conductive fiber is made by an electroless plating process which is used in conjunction with a wet spinning process. The polymer must be catalyzed before the wet gel is collapsed. The resulting filament has a conductive region which is at least partially coincident with the polymer structure.

15 Claims, No Drawings

CONDUCTIVE FIBER AND METHOD OF MAKING SAME

BACKGROUND OF THE INVENTION

1. Field of the Invention

The present invention is related to prior art found in the fields of antistatic fibers, coating processes, and electroless deposition of metals onto substrates. More specifically, the present invention pertains to a conductive fiber and process for making, the process broadly comprising: (a) catalyzing a polymeric material, followed by (b) electrolessly depositing a metal within the polymeric material.

2. Description of the Prior Art

Prior to the reduction to practice of the present invention, the electroless deposition of metals on polymeric materials resulted in a coating of metal upon the polymeric material, as opposed to metal deposition coincident (i.e. within, impregnated into) the polymeric material. Most prior art processes of making electrolessly plated polymeric filaments involved first roughening the surface of the filament (using abrasive materials or acids) followed by catalysis of the surface, followed by electroless deposition of metals at catalytic sites which in turn was followed by autocatalytic deposition of even more metal. Since the prior art processes never formed catalytic sites within the polymer structure, but rather formed catalytic sites only on the surface of the polymer, the resulting deposition of metal formed only a metallic coating on the surface of the polymer. The prior art catalysts were unable to penetrate the polymer structure in order to form catalytic sites within the filamentary polymeric substrate. Furthermore, the antocatalytic activity of the metal being deposited never resulted in the "inward" deposition of metal (i.e. deposition of metal in a direction towards the center of the filamentary cross section). Rather, the autocatalytic activity of the deposited metal resulted in a thicker and thicker coating of the deposited metal onto the surface of the filamentary polymeric substrate. Thus the resulting conductive filament was comprised of two distinct regions: (a) an inner nonconductive polymeric core surrounded by (b) a conductive outer metallic layer. One of the most bothersome characteristics of these conductive filaments was that the adherence of the metal coating to the polymeric substrate was poor, and as a result the metal coating would often chip or pull off in subsequent filament handling or processing operations. For this reason, electrically conductive filaments produced via electroless deposition of metals have not generally been commercially successful.

Applicant is aware of several prior art patents which are relatively close to, but different from, the present invention, including: U.S. Pat. No. 4,201,825; U.S. Pat. No. 3,686,019; U.S. Pat. No. 3,823,035.

U.S. Pat. No. 4,201,825 discloses a process for manufacturing conductive filaments via electroless deposition of metals, but in this patent the metals are deposited only on the surface of the filaments:

"Accordingly, the invention relates to a metalized (metal-coated) textile material, for example filaments, fibers and textile structures, which is obtainable for . . ." Column 1, lines 39–41.

"The residence time of the material to be metalized in the described metalizing bath is determined by the required thickness of the metal layer on the surface of the material." Column 2, lines 13–16.

"After only thirty seconds, the fabric is covered with a thin layer of nickel and is dark in color. After about five minutes, the nickel layer has a thickness of 0.2 micrometers." Column 4, lines 5–7.

U.S. Pat. No. 3,686,019 also discloses only the deposition of metals on the surface of the filaments:

"According to our further developments of the above prior improvement, it is surprisingly found that a highly effective metal coating is realized on a chemical fiber, preferably a thermoplastic fiber, when it is sensitized and activated by deposition on its surface of a nobel metal catalyst . . ." Column 2, lines 31–35.

"Thickness of the metal coating layer should be 0.01 micron, preferably, 0.025–0.25 micron." Column 5, lines 53–54.

"A representative process . . . the thus treated fibrous material is immersed in a catalyzer solution containing nobel metal ions, so as to separate the metal onto the fiber surface . . ." Column 6, lines 11–16.

U.S. Pat. No. 3,823,035, a prior art patent issued to the inventor of the instant invention, also teaches a product and process pertaining to conductive filaments. However, this product has:

". . . finely-divided, electrically-conductive particles uniformly suffused as a phase independent of the polymer substrate . . ." Column 2, lines 41–43.

These conductive particles which are suffused into the polymer are each distinct from one another, and it is known that the conductive characteristics of these filaments result from the fact that the particles are in close enough proximity to one another that an electrical charge will "jump" from particle to particle in its flow through the filament. At least a portion of the conductive particles described in U.S. Pat. No. 3,823,035 are definitely within the polymeric material itself, as opposed to a coating on top of the surface of polymeric material. However, it is believed that these conductive particles do not form an "electrically continuous zone" (i.e. a region through which electrons may flow along a continuous path without having to "jump" from one conductive member to another).

BRIEF SUMMARY OF THE INVENTION

The present invention pertains to electrically conductive polymeric filament and two methods of making same. The conductive filament differs from the prior art in that it has both:

(a) a metallic zone coincident with the polymeric material; and (b) an electrically continuous metallic zone.

As discussed above, products having electrically continuous metallic zones are known, and products in which conductive particles are within (but not coincident with) polymeric materials are known, but the prior art does not show any examples of conductive filaments having both of these characteristics. The product of the present invention is believed to have increased durability over prior art products produced via electroless plating due to the fact that the metal becomes impregnated into the polymer structure instead of simple adhesion of the metal to the polymer surface. Uses for the product of the present invention include conductive textile applications (including antistatic applications) as well as non-textile end uses such as spark plug wires, etc.

Two processes for making the product of the present invention are disclosed herein. The first of these processes comprises catalyzing a polymer (before extrusion, i.e. filament formation), followed by extrusion of the polymer to form filaments, followed by electroless deposition of a metal into the catalyzed polymeric filament in order to form a conductive filament. A second method of making a conductive filament comprises first wet spinning a polymeric strand material so that a wet get structure results, followed by catalyzing the wet gel structure so that catalytic sites are formed throughout at least a portion of the volume of the wet gel, followed by immersing the catalyzed wet gel structures into a plating bath so that a metal is electrolessly deposited within the wet gel structure.

Both of these processes differ from the electroless plating processes of the prior art in that in both processes of the invention catalytic sites are formed within the polymer structure itself, as opposed to merely on the surface of the polymeric filaments. The creation of catalytic sites within the polymer structure could not be achieved in prior art processes because all of these processes utilized a "completed" textile filament as a starting material. In a "completed" filament, i.e. a filament which is substantially suited for textile and uses, the polymer structure is completely closed, i.e. the polymer will not allow entrance of catalysts needed for electroless plating. In contrast, the processes of the present invention provide methods of allowing catalyst into the polymer structure by either mixing the catalyst with the polymer and extruding a substantially uniformly mixed blend of polymer and catalyst or by applying catalyst to a "wet gel" filamentary polymeric structure. A "wet gel" is an intermediate filamentary product resulting from wet spinning. A wet gel consists of an uncollapsed polymer structure which is highly permeable with respect to certain catalysts utilized in electroless plating. Drying a wet gel collapses the polymer and creates a structure which is highly impermeable with respect to catalysts utilized for electroless plating. Generally, rinsing and drying of the wet gel is performed immediately after spinning, but in the process of the present invention the catalyst is applied to the wet gel before it is dryed.

It is an object of the present invention to enable the production of a durable conductive textile filament.

It is another object of the present invention to enable the production of a conductive textile filament by electroless desposition of a metal.

It is a further object of the present invention to enable the production of a conductive textile filament having a metallic zone coincident with the polymer structure.

It is a further object of the present invention to make a textile strand suitable for antistatic purposes.

It is a further object of the present invention to form a conductive filament by catalyzing a wet gel followed by electrolessly depositing metal into the filament.

It is a further object to make a conductive strand from an acrylic fiber.

It is a further object of the present invention to make a conductive strand from polyacrylonitrile homopolymer.

It is a further object of the present invention to make an inexpensive conductive polymeric strand.

It is a further object of the present invention to make a conductive polymeric textile strand which has a conductive core and a non-conductive sheath.

It is further object of the present invention to enable the production of a conductive filament via electroless deposition of a metal, this process being carried out without etching the surface of the strand with acids or abrasive materials.

DETAILED DESCRIPTION OF THE PREFERRED EMBODIMENTS

The present invention is concerned with an electrically conductive filament and two processes for making same. The filament can have any of a wide variety of cross-sectional configurations, and the degree of conductivity of the filaments may be varied over a wide range in order to suit a variety of end uses. The filaments may be produced in either continuous strand form or as staple fibers (i.e. continuous filaments which have been cut into short lengths). Conductive filaments have been utilized for a variety of purposes including antistatic filaments, spark plug wires, etc..

As mentioned above, the filament of the present invention has electrolessly deposited metal within the polymer itself. The electrolessly deposited metal forms an electrically continuous metallic zone, and the metallic zone coincides with that portion of the polymeric strand within which the metal is intersperced. The metallic zone may be located inward from the entire outer perimeter of the filament, or, in contrast, the metallic zone may be located in a core region in which a nonconductive polymeric sheath region surrounds the conductive core region. If the metallic zone is located inward from the perimeter of the filament, the metallic zone always occupies (i.e. is coincident with) at least 1% of the cross sectional area of the filament. This distinguishes the conductive filament of the present invention from the coated conductive filaments of the prior art, as the metallic zone coincides with the polymeric material rather than existing as merely a coating on top of, and within a completely separate volume from, the polymeric material. However, the processes of the present invention may be utilized to produce a conductive filament which has both a metallic zone coincident with the polymeric material and a metallic coating on top of the polymeric strand.

The polymeric material utilized in the present invention is most preferably polyacrylonitrile, and most preferably the filament is wet spun from a solution of polyacrylonitrile dissolved in an aqueous zinc chloride solution. The catalyst may either be added to the polymer-containing salt solution before spinning (i.e. extrusion), or the catalyst may be incorporated into the wet get product. A wet gel exists as the polymeric strand material emerges from the coagulation bath in a wet spinning process. In this state (i.e. the wet gel state) the polymeric structure is relatively open and the catalyst will easily penetrate into the polymer. Once the wet spun strand is dried, the polymer structure "collapses", and accordingly the filament cross sectional area shrinks substantially. Once collapsed, the polymer will not allow either the catalyst or the metal ions to penetrate any significant distance into the internal volume of the filament. Exactly why neither catalyst nor metal ions will penetrate the "collapsed" polymer structure is not known, but possibilities include a geometrical barrier ( i.e. openings are too small), a barrier to charged particles, etc. It has been found that the barrier presented to the catalyst is much greater than the barrier presented to the metal ions, as: (a) a wet gel structure which is catalyzed, then dried, and then subjected to electroless deposition of metal exhibits a high degree of durability and has been found to have a metallic zone which coincides with the polymeric material, this zone being estimated at least 1% to 5% of the cross sectional area of the filament; whereas (b) the same wet gel structure, uncatalyzed, which is collapsed (i.e. dried) and then subjected to classical electroless deposition (via etching, catalyzing, deposition of metal) exhibits a low degree of durability (i.e. the metal coating comes off easily and to an undesireable degree during processing and use) and is believed not to have any metallic zone in which the metal coincides with the polymeric material. The cause for these results is believed to be that in the first instance, (a), catalyst penetrates the polymer structure and resides within the polymer after drying. As wet gel structures are dried, the filament has radially oriented, very small capillaries formed therein, giving the resulting filament a slightly "porous" surface. If the polymer is catalyzed before drying, catalytic sites exist both on the surface of the strand and within the capillaries, and the capillaries provide openings to a small portion of the polymer structure. If the metal deposition is begun after collapsing an already catalyzed wet gel, the metal will deposit both within a small portion of the polymer, within the capillaries, and on the surface of the filament. It is believed that the metal will deposit within at least the outermost 1% to 5% of the filament's cross-sectional area, and additionally upon the surface of the polymer. Experiments have shown that it is critical to catalyze the polymer before collapsing the wet gel, as the resulting conductive filament made in this manner has very good adherence of polymer to metal if catalyzation precedes drying, while the same strand, left uncatalyzed until after drying, exhibits much poorer durability.

It was unexpectedly found that under the proper conditions the catalyst was substantive (i.e. became affixed to) the polyacrylonitrile. The catalyst remained substantive to polyacrylonitrile even though the catalyst was infinitely soluble in water and the fiber was rinsed several times before plating began. Furthermore, the catalyst was substantive to the polymer independently of whether the catalyst was added to the aqueous polymeric solution prior to spinning or whether it was added to the wet gel. However, it was found that the catalyst would not affix itself to the polymeric polyacrylonitrile filament if the filament had been completely dried. Thus it is imperative that catalyization precede the collapse of the wet gel structure.

EXAMPLE I (Prior Art)

A tow (60 filaments, 3 denier per filament) of PAN homopolymer was wet spun (as generally described in U.S. Pat. No. 2,916,348, U.S. Pat. No. 2,558,730, and as found in U.S. Pat. No. 4,201,740), washed, stretched 10 x, and dried at 150° C. Several meters (approximately 0.5 grams) of the tow was then subjected to the following procedure:

(1) In order to remove oil, dirt, and foreign material, the tow was alkaline scoured for two minutes, at 50° C., in 2 liters of water containing an 8% solution of alkaline detergent at a pH of 7;

(2) the tow was then rinsed with water at an ambient temperature;

(3) the tow was then neutralized with a mild acid (pH=4) at ambient temperature;

(4) the tow was then acid etched in a solution (pH=0.66) made from chromic acid (75 g/1) and sulfuric acid (200 g/1);

(5) the tow was then rinsed in water;

(6) the tow was then sensitized for 1 minute, at ambient temperature, in a solution of stannous chloride (20 grams) 35% HCl (85 ml) and water (2 liters);

(7) the tow was then rinsed with deionized water;

(8) the tow was then catalyzed by being immersed in a solution of 0.5 gm. of palladium chloride, 5 ml. of a 35% HCl solution, and 2 liters of water;

(9) the tow was then water rinsed;

(10) the tow was then electrolessly plated with copper (according to U.S. Pat. No. 2,874,072) by being immersed for 10 minutes in a 20° C. solution containing copper nitrate (15 g/liter), sodium bicarbonate (10 g/liter), Rochelle salt (30 g/liter), and a 37% formaldehyde solution (100 ml/liter).

The resulting tow had a metallic copper plating on the individual fibers. The average resistance of the filaments was 1000 ohms per centimeter. The coated filaments were not durable, as shown by the following tests:

A. On flexing (at an angle of 45°) 10 of the filaments over a wire of 5 mil. diameter, the copper coating became cracked and the resulting resistance was above $10^{10}$ ohms/cm.

B. A bundle of the filaments was fastened to a flat sheet, and the sticky side of a piece of adhesive tape was pressed onto the filaments. Upon removing the tape from filaments, the coating was substantially stripped from the filaments, indicating poor adhesion and ductility.

EXAMPLE II (Prior Art)

A tow (60 filaments, 3 denier per filament) of dry polyacrylonitrile terpolymer (containing 90.5% polyacrylonitrile, 1% vinyl sulfonic acid dye receptor monomer, 8.5% methyl acrylate) was wet spun, washed, stretched 10 x, and dried at 150° C. Several meters (approximately 0.5 grams) of tow was then subjected to the following procedure:

(1) The tow was scoured as described in Example 1;

(2) the tow was then rinsed with water at ambient temperature;

(3) the tow was then neutralized with a mild acid (pH=4) at ambient temperature;

(4) the tow was then acid etched by being immersed for two seconds in a solution (pH=0.66) of chromic acid (75 grams/liter) and sulfuric acid (200 grams/liter);

(5) the tow was then rinsed with water;

(6) the tow was then neutralized for 1 minute with a mild acid (pH=4) at a ambient temperature;

(7) the tow was then catalyzed by being immersed for 3 minutes in a 2 liter bath containing approximately 1.64 liters deionized water, 0.36 liters of reagent grade HCl, and 72 grams of Dri-Cat 3 TM (a palladium catalyst manufactured by Borg-Warner Corporation, and discussed in Technical Bulletin PC-404 published by Borg-Warner Chemicals, this catalyst having been purchased in 1975 from Borg-Warner Corporation, International Center, Parkersburg, W. Va. 26101); the bath was kept at 80° F. and was stirred slowly; the catalization was performed exactly as described in Borg-Warner Technical Bulletin PC-404;

(8) the tow was then immersed for 30 seconds in a mild acid (HCl) solution (pH=4.0), this solution acting as an accelerator;

(9) the tow was then immersed for 3 minutes in a 2 liter electroless plating bath of N-35 electroless nickel, exactly as described in Borg-Warner Technical Bulletin P-329-A, the bath containing 1000 ml. deionized water, 200 ml. N-35-1, 600 ml. N-35-3, and 200 ml. N-35-2; the pH of the bath was 8.9; the Borg-Warner solutions (N-35-1, 2, and 3) contained electroless nickel.

The resulting filaments had a resistance of 800 ohms per centimeter. These coated filaments were found not durable, when subjected to test "B" as described in Example 1.

EXAMPLE III

The process described in Example II was carried out exactly as described in Example II except that no acid etching step was performed. The resulting filaments did not receive a plating of nickel thereon, as evidenced by the fact that the filaments exhibited a resistance of infinity (i.e. were completely nonconductive). It is believed that without an acid etching step, there would be no catalyst pickup and therefore no plating would result.

EXAMPLE IV

A tow (60 filaments, 3 denier per filament) of wet gel polyacrylonitrile terpolymer (as utilized in Example II) was wet spun, washed, and stretched 10 x. The wet gel tow was then subjected to the following procedure:

(1) catalyzed exactly as described in step #7 of Example 2;

(2) rinsed with deionized water;

(3) immersed for 30 seconds in a mild acid solution (pH=4.0), this solution acting as a accelerator;

(4) rinsed with deionized water;

(5) immersed for 3 minutes in a 2 liter bath of n-35 electroless nickel, exactly as described in step #9 of Example II.

The resulting filaments were found to be durable when subjected to both durability tests A & B as described in Example I. The metal was not removed by either test. The filaments had a resistance of 600 ohms per centimeter. Upon stretching the filaments the following resistance readings were made:

| % extension | resistance (ohms per centimeter) |
|---|---|
| 0 | 600 |
| 5 | 1200 |
| 10 | 8000 |
| 20 | 100,000 |

A cross sectional photomicrograph indicated that the metal deposition had penetrated the filament to varying degrees (generally 10–20% of the filament's cross-sectional area) at different points along the length of the filament. Also, the filament had a rough, crenulated surface. When compared with unplated control filaments, the conductive filaments produced in Example IV exhibited some decay of the physical properties of tenacity and elongation.

EXAMPLE V

A tow (60 filaments, 3 denier per filament) of wet gel polyacrylonitrile terpolymer (90.5% polyacrylonitrile, 8.5% methyl acrylate, 1% vinyl sulfonic acid) was wet spun, then washed and stretched 10 x. The tow of wet gel was then subjected to the following procedure:

(1) catalyzed exactly as described in step #7 of Example 2;

(2) rinsed with deionized water;

(3) dryed at 150° C. for 10 minutes;

(4) immersed for 30 seconds in a mild acid (HCl) solution (pH=4.0);

(5) immersed for 3 minutes in a 2 liter bath of N-35 electroless nickel, exactly as described in step #9 of Example II.

The resulting filaments were found to be durable when subjected to both durability tests A & B as described in Example I. The metal was not removed by either test. In contrast to the filaments resulting from the procedure described in Example IV, photomicrographs of the filaments produced by the procedure of Example V revealed a smooth surface of metal on the filaments. Furthermore, cross sectional photomicrographs of the filaments produced indicated that the metal had penetrated the polymer cross section to include about 5% of the filament's cross sectional area. The physical properties of the conductive filaments produced by Example V were virtually unchanged when compared with control filaments which were unplated.

EXAMPLE VI

A tow (60 filaments, 3 denier per filament) of wet gel polyacrylontrile homopolymer was wet spun, washed, and stretched 10 x. The tow was then subjected to a procedure exactly as described in Example IV.

Photomicrographs of the filaments revealed a rough, crenulated fiber surface. Some loss of physical properties were observed upon comparison with a control filament which was simply dried (i.e. not catalyzed or plated). The control filaments had an extension to break of 40% and had a tenacity of 4 grams/denier, while the plated filaments had an elongation to break of only 28% and a tenacity of 1.8 grams per denier. The "plated" homopolymer polyacrylonitrile filaments exhibited almost complete penetration of nickel metal via cross-sectional photomicrographs.

EXAMPLE VII

A tow (60 filaments, 3 denier per filament) of wet get polyacrylonitrile homopolymer was wet spun, washed, and stretched 10 x. The tow was then subjected to a procedure exactly as described in Example V (i.e. dried after catalyzation but before plating).

Photomicrographs of the filaments revealed a smooth surface having a round cross section with metal deposited within approximately the outermost 5% of the cross sectional area of the filaments. The filaments had a resistance of approximately 200 ohms per centimeter. When compared with unplated control filaments, the filaments produced in Example VII had physical properties of tenacity and elongation virtually unchanged. These conductive filaments exhibited durability via both tests A & B as described in Example I.

EXAMPLE VIII

Borg-Warner Dri-Cat 3 TM, a solid, was dissolved in 35% HCl in an amount which yielded a concentration of 5 grams of palladium per liter, as determined by standard analytical techniques. Two liters of this colloidal solution of stannous chloride and palladium chloride were mixed with 50 lbs. of homopolymer polyacrylonitrile aqueous zinc chloride solution which had a pH of 4.0. The homopolymer polyacrylonitrile contained 10.5% polyacrylonitrile solids and 89.5% of an aqueous 60% zinc chloride solution, by weight. The resulting mixture contained 0.5 grams of palladium per kilogram of polyacrylonitrile homopolymer. This catalyzed solution was wet spun into filaments, the mixture undergoing extrusion, coagulation, washing, and hot stretch.

A portion of the resulting wel gel was nickel coated exactly as described in step 5 of Example V. It was surprising to find that the catalyst remained in the polymeric filamentary structure even though the water soluble acidic catalyst solution was not washed out in the coagulation bath or in the wash or hot stretch steps (the pH of the wet gel was regulated so that no accelerator step was required). The rough, crenulated filaments exhibited durability in that metal was not removed when the filaments were subjected to tests A & B of Example I. However, tenacity and elongation dropped with respect to an unplated control sample. The resistivity of the filaments was approximately 1000 ohms per centimeter per filament.

EXAMPLE IX

A tow (60 filaments, 3 denier per filament) of homopolymer polyacrylonitrile filaments was produced exactly as described in Example VIII except that: (a) the dried fiber was immersed for 30 seconds in a mild acid solution, and (b) the tow was dried completely before the plating process was performed. The resulting filaments had a resistivity of approximately 1000 ohms per centimeter per filament. The filaments had a smooth surface and were found to be durable upon undergoing tests A & B of Example I. The smooth filaments had physical properties of tenacity and elongation virtually unchanged with respect to an unplated control sample.

EXAMPLE X

A tow (60 filaments, 3 denier per filament) of terpolymer polyacrylonitrile filaments (90.5% polyacryonitrile, 8.5% methyl acrylate, 1% vinyl sulfonic acid dye site monomer) was produced by the method described in Example VIII. The catalyst remained in the polymeric filamentary structure. The rough, crenulated filaments exhibited durability in that metal was not removed when the filaments were subjected to tests A & B of Example I. Tenacity and elongation dropped with respect to an unplated control sample. The resistivity of the filaments was approximately 1000 ohms per centimeter per filament.

EXAMPLE XI

A tow (60 filaments, 3 denier per filament) of terpolymer polyacrylonitrile filaments (90.5% polyacrylonitrile, 8.5% methyl acrylate, 1% vinyl sulfonic acid dye site monomer) was produced by the method described in Example IX. The catalyst remained in the polymer structure. The smooth filaments exhibited durability when subjected to tests A & B of Example I. Tenacity and elongation were virtually unchanged with respect to an unplated control sample. The resistivity of the filaments was approximately 1000 ohms per centimeter.

Examples I and II illustrate processes and products of the prior art. Example III reveals the requirement of acid etching in prior art electroless plating methods. It should be noted that the metallic coating obtained in Examples I and II was not a durable coating.

Example IV illustrates a process of the present invention as applied to terpolymer polyacrylonitrile, which resulted in conductive, durable filaments. Example VI is identical to Example IV except that the polymer is a homopolymer polyacrylonitrile (100% polyacrylonitrile units make up the polymer). It should be noted that in both of these examples the physical properties of the filaments were lowered by the plating process. Also, the metal penetrated the wet gel homopolymer structure further than it penetrated the wet gel terpolymer structure (90% vs 15%).

Examples V and VII pertain to the same basic process as Examples IV and VI except that the catalyzed wet gel is dried before plating is carried out. The result is a smooth fiber which does not lose physical properties to any significant degree. In both Examples V and VII, the metal penetrated the filament's cross-sectional area only about 5%.

Examples VIII through XI illustrate the alternative process of electroless deposition via mixing the catalyst with the polymer solution prior to wet spinning. Although only Borg-Warner's Dri-Cat 3 TM was utilized in the examples, it is believed that any adequate electroless plating catalyst would render this process operable. Just as in Examples IV through VII, Examples VIII through XI utilize both homopolymer polyacrylonitrile and terpolymer acrylonitrile. Likewise, Examples VIII through XI vary the process by drying the wet gel both before and after the plating process, with similar results as in Examples IV through VII.

It has been conceived that the processes of the present invention are operable for any wet spinning process. It is imperative that the polymer be catalyzed before the wet gel structure is collapsed. The processes of course may involve different lengths of immersion time than those provided in the Examples, as would be recognized by one of skill in the art.

In addition to the Examples given above, it has been conceived that sheath/core structures may be produced with conductive cross and nonconductive sheaths by simply coextruding a catalyzed core surrounded by an uncatalyzed sheath, thereafter subjecting the wet gel to the plating process, resulting in the formation of a conductive core.

Other conductive filaments made by processes similar to the Examples described above have rendered filaments having as low a resistance as 50 ohms per centimeter per filament. Of course, plating times were longer in the production of these filaments in order that a greater degree of metal deposition occurred. Filaments having a resistance above $10^{10}$ ohms per centimeter are not known to be useful for antistatic purposes, thus it is for this reason that the useful conductive filaments of the present invention have a resistance between $10^{10}$ and 50 ohms per centimeter per filament.

The specification and Examples herein are intended to convey the essential concepts of the present invention. The invention is not intended to be limited to the specifics of the Examples, but rather is bounded only by the essential concepts described herein.

We claim:

1. A process of making an electrically conductive polymeric filament comprising:
   (a) mixing a catalyst with a polymer wherein said polymer is catalyzed for electroless deposition of a metal;
   (b) extruding the mixture of step (a) to form a catalyzed filamentary polymeric material; and
   (c) electrolessly depositing a metal coincident with said catalyzed filamentary polymeric material to form said conductive polymeric filament; wherein said conductive polymeric filament has a metallic zone occupying at least 1% of the cross-sectional area of said conductive polymeric filament.

2. The process recited in claim 1 wherfein said meterial of step (a) is extruded as a core portion in a sheath/core bicomponent filament, the sheath portion of the bicomponent filament being comprised of an uncatalyzed polymeric material.

3. The process recited in claim 1 wherein said metal is selected from the group consisting of nickel, copper, silver, tin, gold, cobalt, zinc, chromium, and palladium.

4. The process recited in claim 1 wherein said conductive filament has a resistance in the range of from about 50 ohms per centimeter per filament to about $10_{10}$ ohms per centimeter per filament.

5. A process of making an electrically conductive polymeric filament comprising:

(a) wet spinning a polymeric strand material to produce a wet gel filamentary structure;

(b) catalyzing said wet gel filamentary structure whereby catalytic sites are formed throughout at least a portion of the volume of said wet gel filamentary structure; and, (c) immersing said catalyzed wet gel filamentary structure into a plating bath whereby a metal is electrolessly deposited coincident in said wet gel filamentary structure.

6. The process recired in claim 1 wherein said polymer is a polyacrylonitrile polymer.

7. The process recited in claim 6 wherin said ctalyst is a palladium catalyst.

8. The process recited in claim 5 wherein said polymer comprises a polyacrylonitrile polymer.

9. The process recited in claim 8 wherein said wet gel filamentary strucutre is catalyzed with a palladium catalyst.

10. The process recited in claim 6 wherein said catalyzed filamentary material is dired prior to electrolessly depositing said metal in said polymeric material.

11. The process recited in claim 6 whereein said metal is electrolessly deposited in said catalyzed filamentary structure prior to drying of the filamentary material.

12. The process recited in claim 8 wherein said catalyzed filamentary wet gel structure is dried prior to electrolessly depositing said metal in the filamentary strucutre.

13. The process recited in claim 8 wherein said metal is electrolessly deposited in said wet gel filamentary structure prior to drying of the filamentary structure.

14. The process recited in claim 8 wherein said wet spinning of said polymeric strand material is from a solution of polyacrylonitrile dissolved in an aqueous zinc chloride solution.

15. The process recited in claim 2 wherein said metal is selected from the group consisting of nickel, copper, silver, tin, gold, cobalt, zinc, chromium, and palladium.

* * * * *